US010794183B2

(12) United States Patent
Xu

(10) Patent No.: US 10,794,183 B2
(45) Date of Patent: Oct. 6, 2020

(54) SELF-DRILLING DIFFERENTIAL GROUTING COMBINED BOLT AND ANCHORING METHOD THEREFOR

(71) Applicant: CHINA UNIVERSITY OF MINING AND TECHNOLOGY, Xuzhou (CN)

(72) Inventor: Guoan Xu, Nanjing (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 16/478,835

(22) PCT Filed: Aug. 28, 2018

(86) PCT No.: PCT/CN2018/102657
§ 371 (c)(1),
(2) Date: Jul. 17, 2019

(87) PCT Pub. No.: WO2019/052331
PCT Pub. Date: Mar. 21, 2019

(65) Prior Publication Data

US 2020/0056479 A1 Feb. 20, 2020

(30) Foreign Application Priority Data

Sep. 12, 2017 (CN) ..... 2017 1 0815492

(51) Int. Cl.

| | |
|---|---|
| ***E21D 21/00*** | (2006.01) |
| ***E02D 5/80*** | (2006.01) |
| ***E21D 20/00*** | (2006.01) |
| ***E21D 20/02*** | (2006.01) |
| *E02D 5/74* | (2006.01) |

(52) U.S. Cl.
CPC ..... *E21D 20/003* (2013.01); *E21D 20/021* (2013.01); *E02D 5/74* (2013.01); *E21D 20/028* (2013.01); *E21D 21/0026* (2013.01); *E21D 21/0086* (2013.01)

(58) Field of Classification Search
CPC ..... E21D 21/008; E21D 21/0033; E02D 5/80; E02D 5/803; E02D 5/805
See application file for complete search history.

(56) References Cited

U.S. PATENT DOCUMENTS 4,547,106 A * 10/1985 Lipsker ..... E02D 5/803 405/237

FOREIGN PATENT DOCUMENTS

| | | |
|---|---|---|
| CN | 1963043 | 5/2007 |
| CN | 205189915 | 4/2016 |
| CN | 205422779 | 8/2016 |
| CN | 106567722 | 4/2017 |

(Continued)

*Primary Examiner* — Sean D Andrish
(74) *Attorney, Agent, or Firm* — Treasure IP Group, LLC

(57) ABSTRACT

A self-drilling differential grouting combined bolt and method of anchoring the same are described. The bolt consists essentially of a drill (1), a grouting pipe (2), a spindle (3), a bolt head mechanism and a bolt tail mechanism, wherein the bolt head mechanism comprises a fixed ring (4), a slip ring (7), a limiting pipe (6) and several pairs of driven linkages (501) and driving linkages (502); and the bolt tail mechanism comprises a bolt disc (11), a connecting cap (12), a spring (13) and a nut (14). The method of anchoring includes the steps of hole drilling, hole expanding at inner anchor end, differential grouting rock bolt fastening.

11 Claims, 13 Drawing Sheets

(56) References Cited

FOREIGN PATENT DOCUMENTS

| | | | |
|---|---|---|---|
| CN | 107387141 | | 11/2017 |
| CN | 207161130 | | 3/2018 |
| FR | 2521212 | | 8/1983 |
| GB | 2441018 | * | 2/2008 |

* cited by examiner

SELF-DRILLING DIFFERENTIAL GROUTING COMBINED BOLT AND ANCHORING METHOD THEREFOR

CROSS REFERENCE TO RELATED APPLICATION

This application claims priority to a PCT application PCT/CN2018/102657, filed on Aug. 8, 2018, which in turn takes priority of Chinese Application No. 201710815492.3, filed on Sep. 12, 2017. Both the PCT application and Chinese Application are incorporated herein by reference in their entireties.

BACKGROUND

Technical Field

The present invention relates to a supporting member and its supporting method for soft and fractured rocks, in particular to a self-drilling differential grouting composite rock bolt and an anchoring method.

Related Technology

The support of weak and fractured surrounding rock is one of the key issues in the field of stability control of geotechnical engineering. At present, the common effective treatment method for this kind of surrounding rock is to first reinforce the fractured surrounding rock by grouting, and then to support the grouted surrounding rock by adopting rock bolts, anchor cables, etc.

The grouting process is usually realized by conventional grouting rock bolts or self-drilling grouting rock bolts. The conventional grouting rock bolt has the advantages of simple structure, easiness in processing and low cost, but it is not easy for the conventional grouting rock bolt to enter the bolting hole because of the hole collapse, and it needs to be fixed and sealed specially, which is lengthy and not conducive to rapid installation. The self-drilling grouting rock bolt avoids the influence of hole collapse, but it still needs to be fixed and sealed before grouting.

The key problem of current combined support with grouting and bolting is that the grouting reinforcement and the installation of rebar rock bolt are often carried out in two steps. On the one hand, the drilling workload is very high and time-consuming, which not only leads to the slow construction speed, but also greatly increases the engineering cost. On the other hand, there is no strong coupling between the grouting rock bolt and the rebar rock bolt, consequently the synergistic anchoring effect is weak, and the anchoring performance and reliability of the support system are low.

In order to overcome the above-mentioned defects of the existing combined support technology with grouting and bolting, it is necessary to develop a composite rock bolt which combines the functions and advantages of the grouting rock bolt and the high-strength rebar rock bolt.

SUMMARY OF THE INVENTION

The purpose of the present invention is to overcome the defects of the prior support technology, provide a self-drilling differential grouting composite rock bolt and an anchoring method thereof. Under the condition of improving the supporting effect, the supporting process of weak and fractured surrounding rock is sped up and the engineering cost is reduced.

The present invention provides a self-drilling differential grouting composite rock bolt, consisting of a drill bit, a grouting pipe, a main shaft, an anchor head assembly and an anchor tail assembly.

The drill bit is connected to the front end of the main shaft, the grouting pipe is sleeved over the main shaft. The inner diameter of the grouting pipe is greater than the diameter of the main shaft, so a grouting passage is formed between the grouting pipe and the main shaft.

The anchor head assembly includes a sliding ring, a limiting pipe, and a plurality of pairs of driven connecting rods and driving connecting rods. The sliding ring is sleeved over the main shaft and connected to the front end of the grouting pipe (the end at which the drill bit is located is the front end). The limiting pipe is sleeved over the main shaft and located between the drill bit and the sliding ring; the limiting pipe is shorter than the total length of one pair of driving and driven connecting rods; the limiting pipe is provided with some grouting holes. The driven connecting rods are uniformly distributed in the circumferential direction and hinged to the front end of the main shaft; the driving connecting rods are uniformly distributed in the circumferential direction and hinged to the sliding ring; the driven connecting rods and the driving connecting rods are hinged in pairs.

The anchor tail assembly includes an anchor plate and a connecting nut, the anchor plate is sleeved over the rear end of the grouting pipe, and the connecting nut is sleeved over the main shaft and blocks the rear end of the grouting pipe. The connecting nut is provided with a grouting hole connected with the inner space of the grouting pipe. The anchor plate is also provided with a grouting hole.

The further optimized schemes of the present invention are as follows.

Optimized scheme 1: The anchor head assembly further includes a fixed ring, and the fixed ring is fixed at the front end of the main shaft. Each driven connecting rod is hinged to the fixed ring, and the front end of the limiting pipe is fixed on the fixed ring.

Optimized scheme 2: When the driven connecting rods are at a position parallel to the main shaft, the inner side of each driven connecting rod is in contact with the outer surface of the limiting pipe, and the radius of the circle formed by hinging points on the sliding ring is smaller than the radius of the circle formed by hinging points on the fixed ring, thereby guaranteeing that three hinging points of each pair of driving connecting rod and driven connecting rod are always not co-linear.

Optimized scheme 3: A foldable connecting rod unit is provided between adjacent driving connecting rods, and a grout stop screen is provided between each foldable connecting rod unit and the sliding ring.

Optimized scheme 4: The foldable connecting rod unit consists of two brace rods and a ratchet box; the two brace rods are connected at one end by the ratchet box, and hinged at the other end to two adjacent driving connecting rods.

Optimized scheme 5: The inner wall of the sliding ring is provided with grooves in axial direction, through which grout can enter the limiting pipe from the grouting pipe.

Optimized scheme 6: A spring is sleeved over the connecting nut; next to the connecting nut is a locknut whose outer end is provided with a locking ring capable of preventing the nut from being loosened. The spring enables the rock bolt to act in time and stay in an active supporting state for a long time.

Optimized scheme 7: A grout stop plug is sleeved over the outer part of the grouting pipe, and one grouting hole and one exhaust hole are drilled at two positions of both the grout stop plug and the anchor plate.

Optimized scheme 8: Each of the grouting pipe and the main shaft is integral or formed by a plurality of pipes (shafts) connected by using connecting sleeves.

By using the composite rock bolt provided by the present invention, hole drilling, hole expanding at the inner anchor end and differential grouting (fracture grouting is performed at the inner anchor end through the gap between the grouting pipe and the main shaft, and permeation grouting is performed at the other sections through the gap between the grouting pipe and the bolting hole), and timely active supporting can be performed in weak and fractured surrounding rock. The grouting pipe anchors the surrounding rock in a small range by full-length anchorage; the main shaft squeezes and reinforces the surrounding rock in a large range including the grouting pipe anchorage zone; the grouting pipe anchorage zone and the main shaft anchorage zone interact with each other and cooperatively bear the load, such that the supporting effect can be effectively improved.

A method for anchoring the self-drilling differential grouting composite rock bolt includes the following steps:

step 1: hole drilling: removing the spring and nut of the composite rock bolt, adjusting the connecting nut to make driven connecting rods to be parallel to the main shaft, using a bolter to rotate the composite rock bolt to drill a bolting hole with preset depth;

step 2: hole expanding at inner anchor end: gradually adjusting the connecting nut to enable the grouting pipe to push the sliding ring to the bottom of the hole such that driving connecting rods push the driven connecting rods to protrude in the radial direction, at the same time, using the bolter to rotate the rock bolt to enable the hole diameter of the inner anchor end (the end at which the rock bolt enters the bolting hole is called the inner anchor end, also known as the front end of the rock bolt, and the other end of the rock bolt is called the outer anchor end, also known as the rear end) to be gradually expanded, and completing the hole expanding of the inner anchor end when the sliding ring is stopped by the limiting pipe;

step 3: differential grouting: first connecting the grouting pipeline with the grouting hole of the connecting nut, performing fracture grouting to rocks around the inner anchor end through the internal part of the grouting pipe by adopting high grouting pressure, then connecting the grouting pipeline with the grouting hole of the anchor plate, and performing permeation grouting to rocks around the grouting pipe through the gap between the grouting pipe and the bolting hole;

step 4: rock bolt fastening: after grout is initially solidified, mounting the spring and the locknut at the outer anchor end, and applying a certain pre-tightening force to the surrounding rock by using the locknut to compress the spring to produce a certain amount of compression.

The present invention has the following beneficial effects.

(1) The present invention combines the grouting pipe and the high-strength main shaft to simultaneously provide the functions of grouting and high-strength anchoring. It can not only improve the supporting effect, but also reduce the number of bolting holes. Consequently, it can save construction time supporting cost.

(2) The self-drilling function of the rock bolt avoids the bad influence of hole collapse on the installation of the rock bolt; the composite rock bolt is easy to assemble; the rock bolt with appropriate size and mechanical parameters can be designed according to specific rock characteristics and stress conditions.

(3) The large-diameter anchor head and the large-scale reinforcement zone of fracture grouting ensure that the inner anchoring point is firm, stable and reliable.

(4) The spring at the outer anchor end not only enables the rock bolt to act in time and stay in an active supporting state for a long time, but also plays a certain role of resisting impact. These features guarantee good supporting effect and adaptability.

(5) Differential grouting takes account of both reinforcement and yielding to obtain good anchoring effect. The fracture grouting at the inner anchor end can connect the internal anchoring points of adjacent rock bolts into a whole body to ensure the stabilization of the inner anchor end; while the permeation grouting at the other parts can leave some unconsolidated surrounding rock between adjacent rock bolts to provide a compressive deformation space and play the role of yielding.

(6) The small-range anchorage zone formed by the grouting pipe which acts as a full-length bonded rock bolt and the large-scale anchorage zone controlled by the main shaft which acts as a high-strength rock bolt interact cooperatively with each other to bear the load, such that the supporting effect can be greatly improved.

DETAILED DESCRIPTION

The present invention will be further described below in combination with the accompanying drawings and the embodiments.

Figure 1:
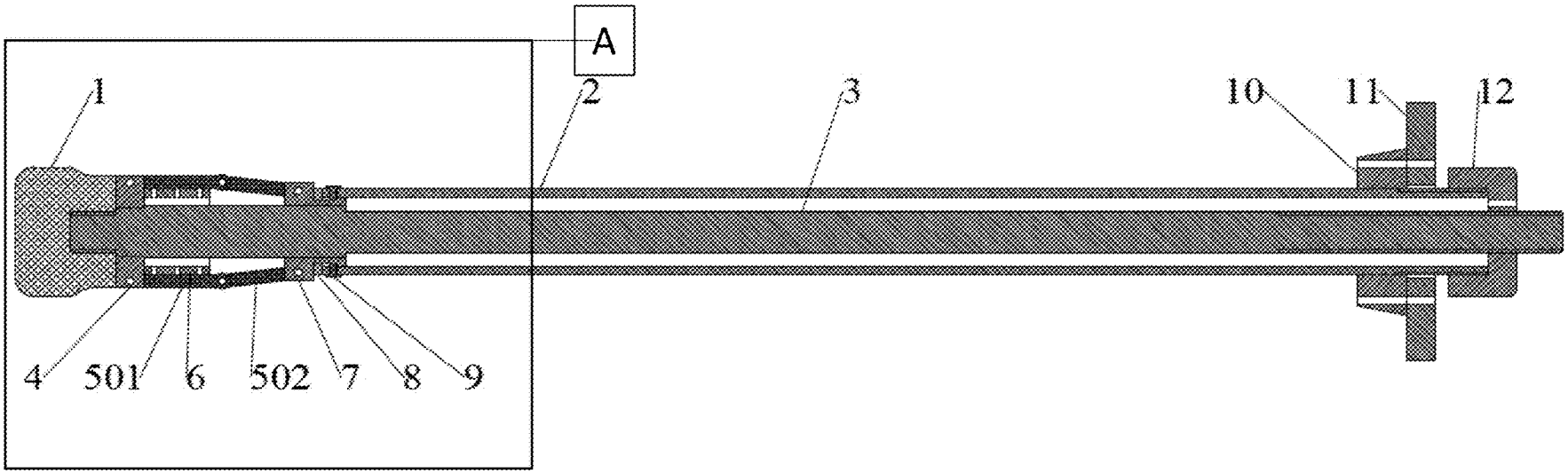
FIG. 1 is a structural schematic view of a self-drilling differential grouting composite rock bolt provided by the present invention (longitudinal sectional view, in which driven connecting rods are parallel to a main shaft).
Figure 2:
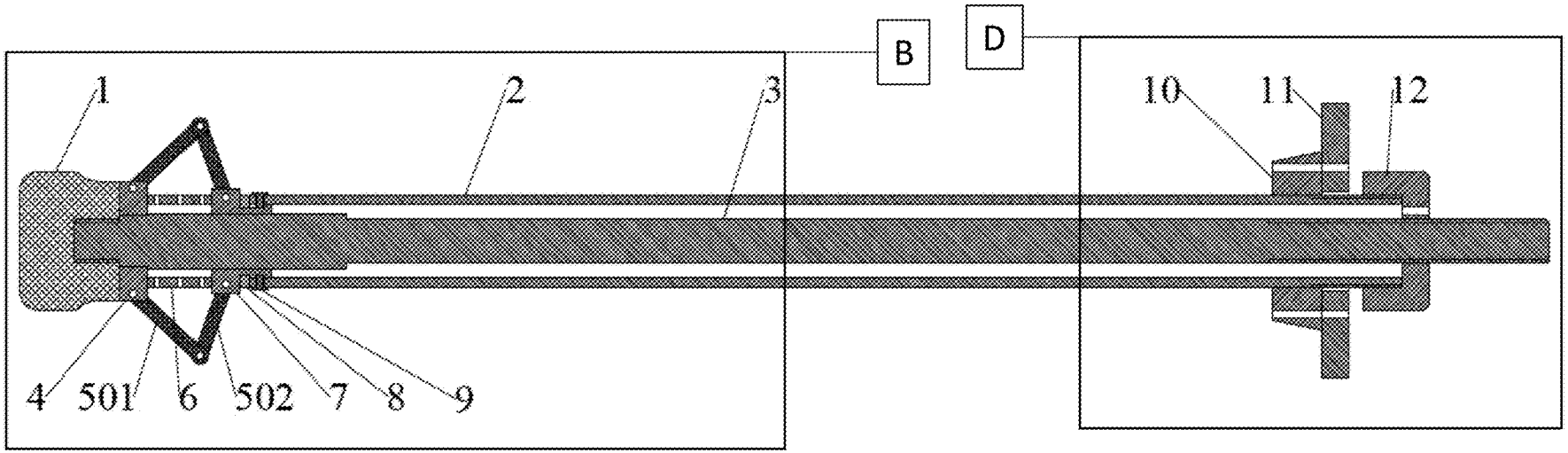
FIG. 2 is a structural schematic view of the self-drilling differential grouting composite rock bolt provided by the present invention (longitudinal sectional view, in which an anchor head assembly are in an expanded state).
Figure 3:
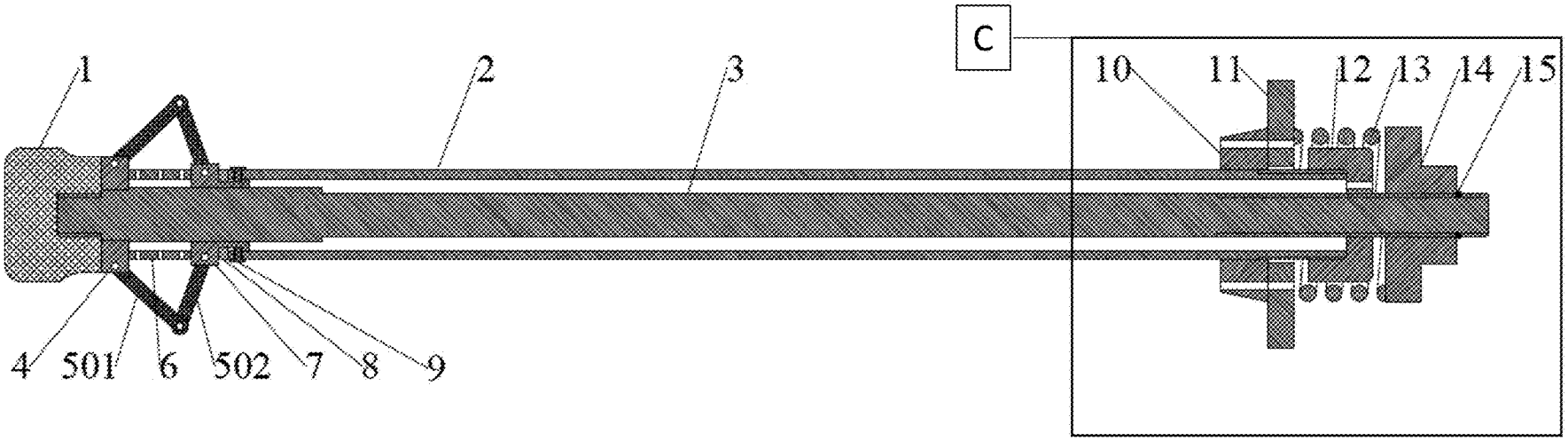
FIG. 3 is a structural schematic view of the self-drilling differential grouting composite rock bolt provided by the present invention (longitudinal sectional view, in which the anchor head assembly are in an expanded state and springs and nuts are installed at the outer anchor end).

As illustrated in FIGS. 1-3, the present invention provides a self-drilling differential grouting composite rock bolt. The composite rock bolt consists of components such as a drill bit 1, a grouting pipe 2, a main shaft 3, an anchor head assembly and an anchor tail assembly. The front end of the main shaft 3 is a threaded rod, the rear part of the drill bit 1 is provided with a threaded hole, and the drill bit 1 is in threaded connection with the front end of the main shaft 3. The anchor head assembly includes a fixed ring 4, six pairs of driven connecting rods 501 and driving connecting rods 502, a limiting pipe 6 and a sliding ring 7. The six pairs of driven connecting rods 501 and driving connecting rods 502 are uniformly distributed along the circumference. The fixed ring 4 is fixed at the front end of the main shaft and is close to the rear part of the drill bit 1. The fixed ring 4 and the driven connecting rods 501, the driven connecting rods 501 and the driving connecting rods 502, and the driving connecting rods 502 and the sliding ring 7 are all hinged. The sliding ring 7 is sleeved over the main shaft 3; the limiting pipe 6 is located between the fixed ring 4 and the sliding ring 7 and drilled some grouting holes on its periphery. The front part of the grouting pipe 2 is connected to the sliding ring by adopting pins; a sealing ring 8 is provided between the front end of the grouting pipe and the sliding ring to seal the joint face.

Figure 4:
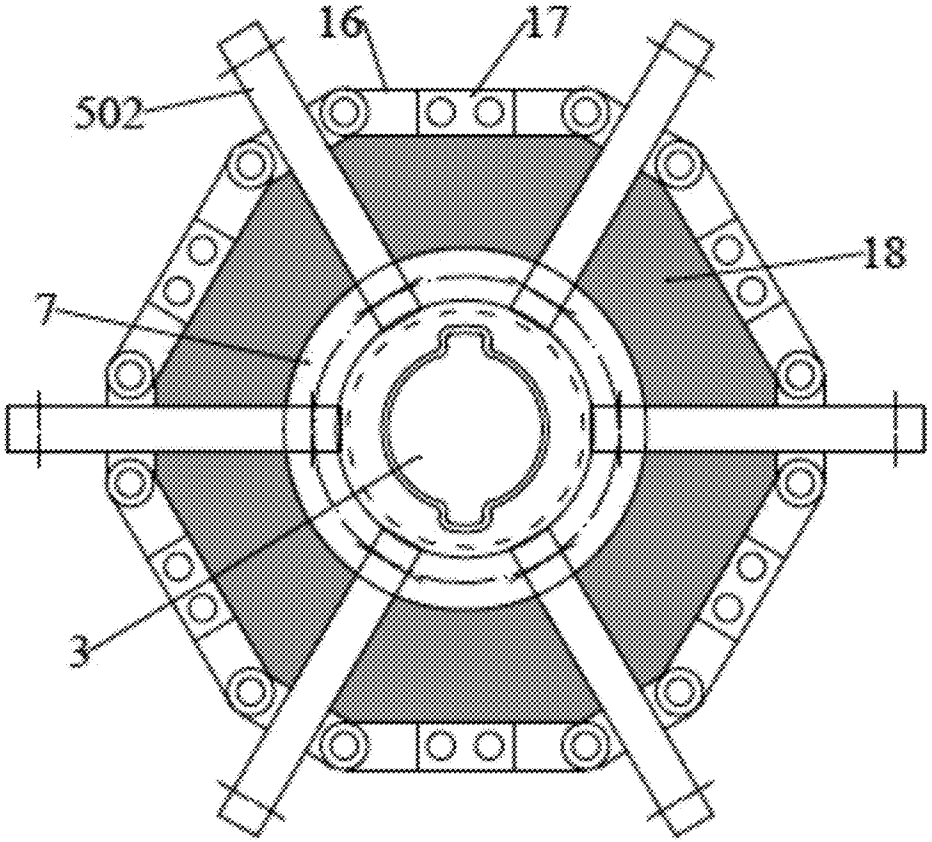
FIG. 4 is a schematic view of a self-drilling differential grouting composite rock bolt provided by the present invention when a grout stop screen is opened.
Figure 5:
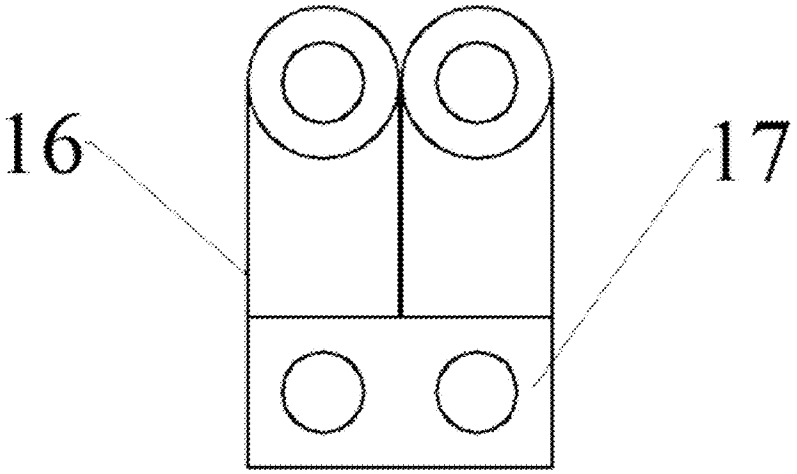
FIG. 5 is a schematic view of a foldable connecting rod unit when the foldable connecting rod unit is folded.
Figure 6:
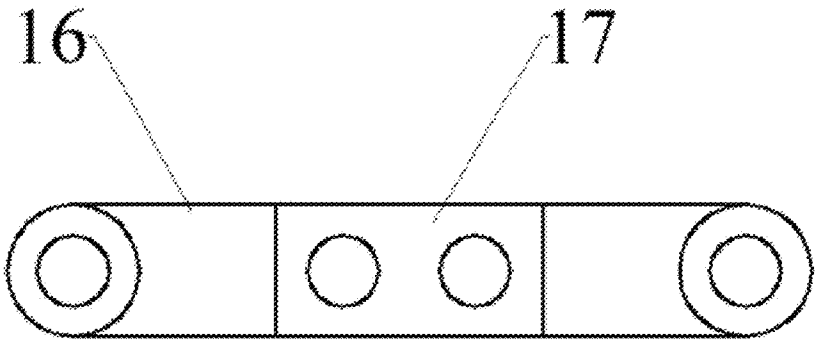
FIG. 6 is a schematic view of a foldable connecting rod unit when the foldable connecting rod unit is unfolded.

As illustrated in FIG. 4, a foldable connecting rod unit is provided between adjacent driving connecting rods 502, and a grout stop screen 18 is provided between each foldable connecting rod unit and the sliding ring 7. As illustrated in FIGS. 5 and 6, the foldable connecting rod unit consists of two brace rods 16 and a ratchet box 17; the two brace rods are connected at one end by the ratchet box, and hinged at the other end to two adjacent driving connecting rods.

The anchor tail assembly includes an anchor plate 11, a connecting nut 12 for closing the outer end of the grouting pipe, a spring 13, a nut 14 and a locking ring 15. The anchor plate 11 is sleeved over the outer part of the grouting pipe 2; the spring 13 is sleeved over the connecting nut 12; the spring is compressed between the anchor plate 11 and the nut 14, and the outer end of the nut 14 is provided with a locking ring 15 capable of preventing the nut from being loosened. By rotating the nut 14 to enable the spring 13 to act on the anchor plate 11, the rock bolt can be fastened.

According to the demand for the length of the rock bolt, each of the grouting pipe 2 and the main shaft 3 may be integral, or may be formed by a plurality of sections connected by using connecting sleeves. A grout stop plug 10 is sleeved over the outer part of the grouting pipe 2. One grouting hole and one exhaust hole are drilled at two positions of both the grout stop plug 10 and the anchor plate 11, and a grouting hole is also drilled in the connecting nut. When the driven connecting rods 501 are parallel to the main shaft 3, the inner sides of all driven connecting rods 501 are just in contact with the outer surface of the limiting pipe 6, and the radius of the circle formed by hinging points on the sliding ring 7 is smaller than the radius of the circle formed by hinging points on the fixed ring 4, thereby guaranteeing that three hinging points of each pair of driving connecting rod 502 and driven connecting rod 501 are always not co-linear, such that the driving connecting rods can smoothly push the driven connecting rods to enlarge the bolting hole around inner anchor end.

Figure 7:
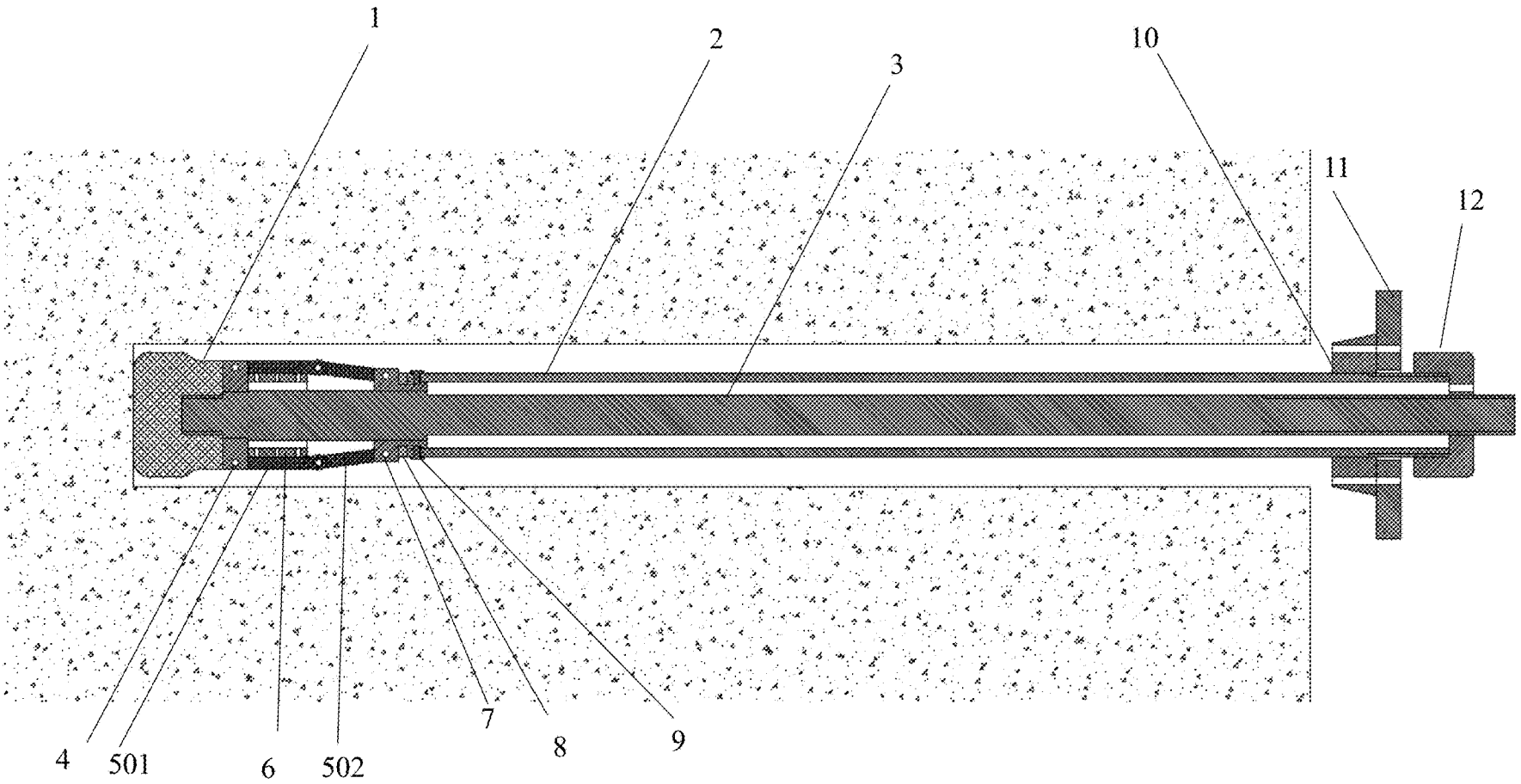
FIG. 7 is a schematic view of a self-drilling differential grouting composite rock bolt provided by the present invention when hole drilling is completed.

A method for anchoring the self-drilling differential grouting composite rock bolt includes the following steps:

As illustrated in FIG. 7, in step 1, hole drilling is performed. The spring and nut of the composite rock bolt are removed, and a connecting nut is adjusted to make driven connecting rods to be parallel to a main shaft. The composite rock bolt is driven by a bolter to rotate to drill a bolting hole till preset depth is reached.

Figure 8:
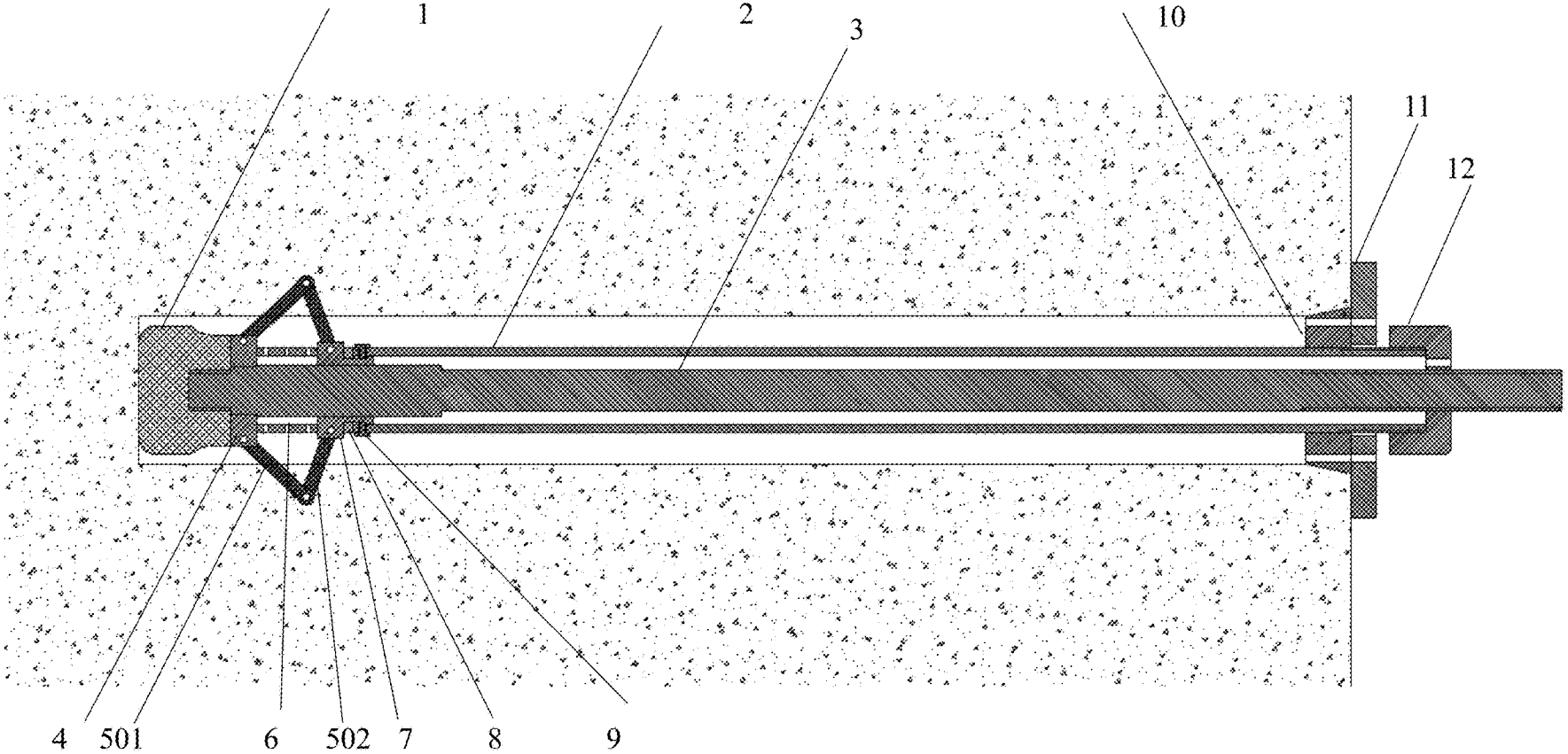
FIG. 8 is a schematic view of a self-drilling differential grouting composite rock bolt provided by the present invention after hole expanding at the inner anchor end.

As illustrated in FIG. 8, in step 2, hole expanding at the inner anchor end is performed. The connecting nut is gradually adjusted to enable a grouting pipe to push a sliding ring to the bottom of the hole such that driving connecting rods push the driven connecting rods to protrude in the radial direction; at the same time, the rock bolt is driven by the bolter to rotate to enable the hole diameter of the inner anchor end to be gradually expanded; the hole expanding of the inner anchor end is completed when the sliding ring is unable to move further to the bottom of the hole due to the block of the limiting pipe.

Figure 9:
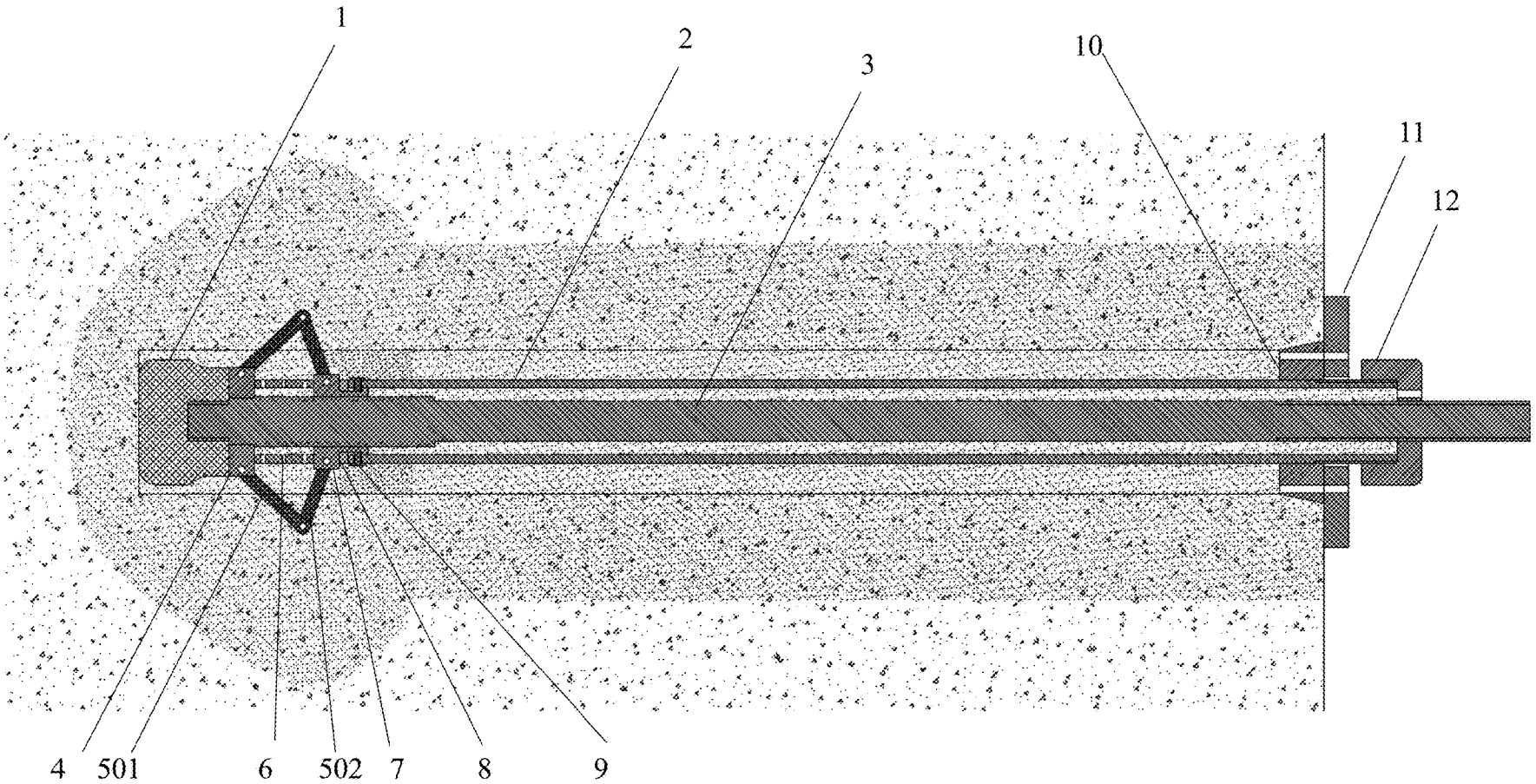
FIG. 9 is a schematic view of a self-drilling differential grouting composite rock bolt provided by the present invention after differential grouting.

As illustrated in FIG. 9, in step 3, differential grouting is performed. First, the grouting pipeline is connected to the grouting hole of the connecting nut; fracture grouting is performed to rocks around the inner anchor end through the internal part of the grouting pipe by adopting high grouting pressure. Then, the grouting pipeline is connected to the grouting hole of the anchor plate, and permeation grouting is performed to rocks around the grouting pipe through the gap between the grouting pipe and the bolting hole.

Figure 10:
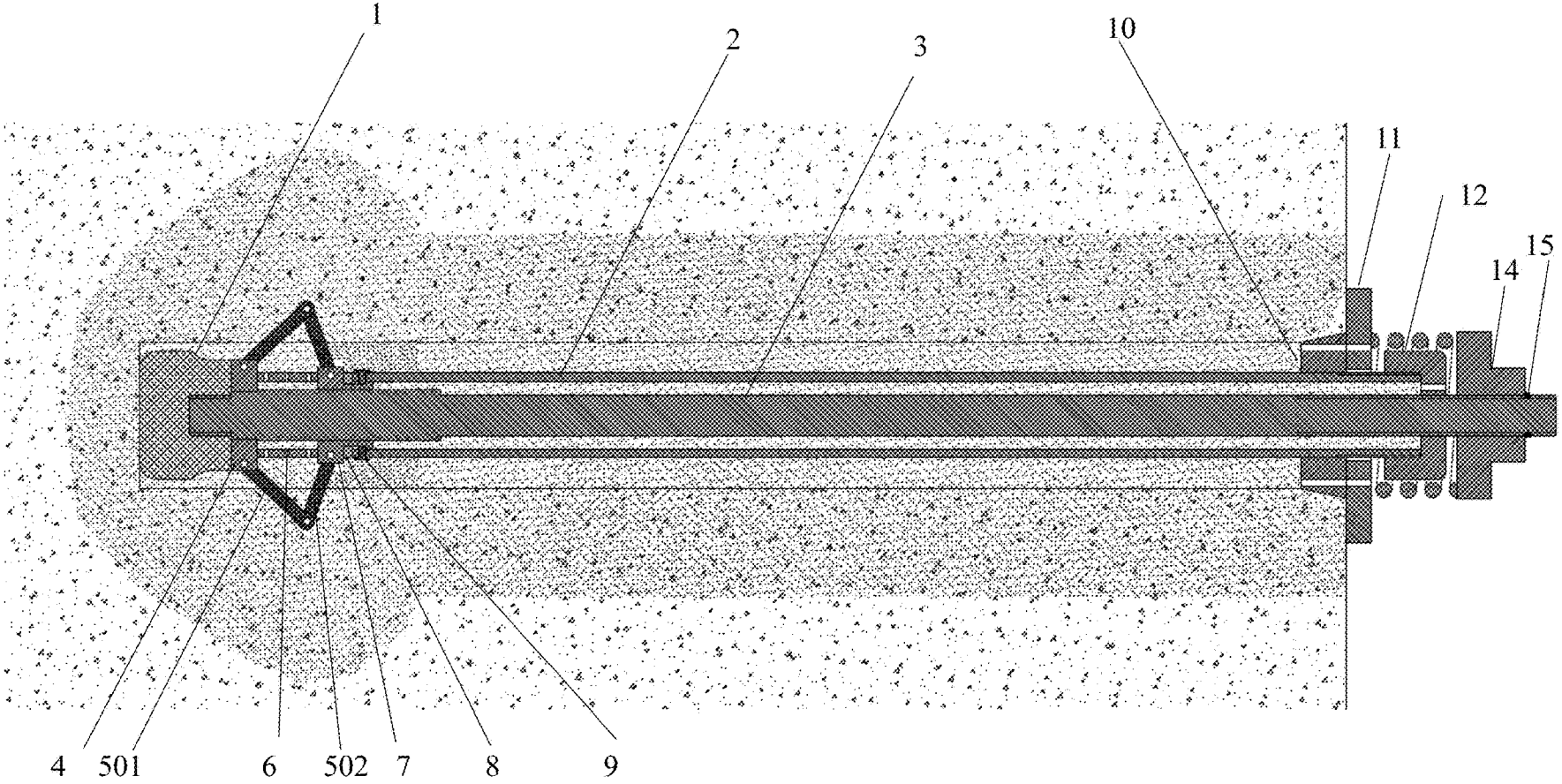
FIG. 10 is a schematic view of a self-drilling differential grouting composite rock bolt provided by the present invention after fastening.
Figure 11:
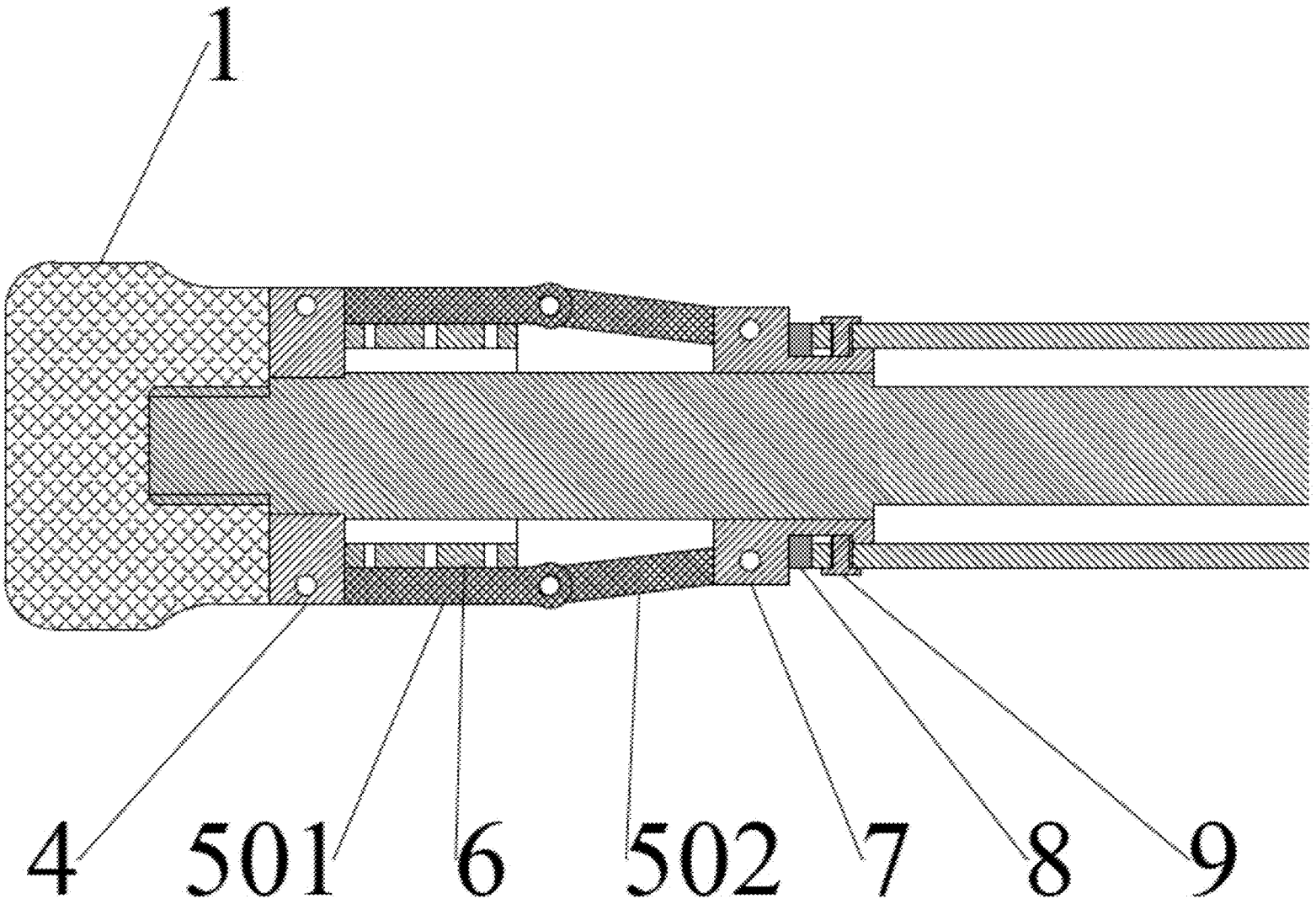
FIG. 11 is an expanded view of region A of FIG. 1.
Figure 12:
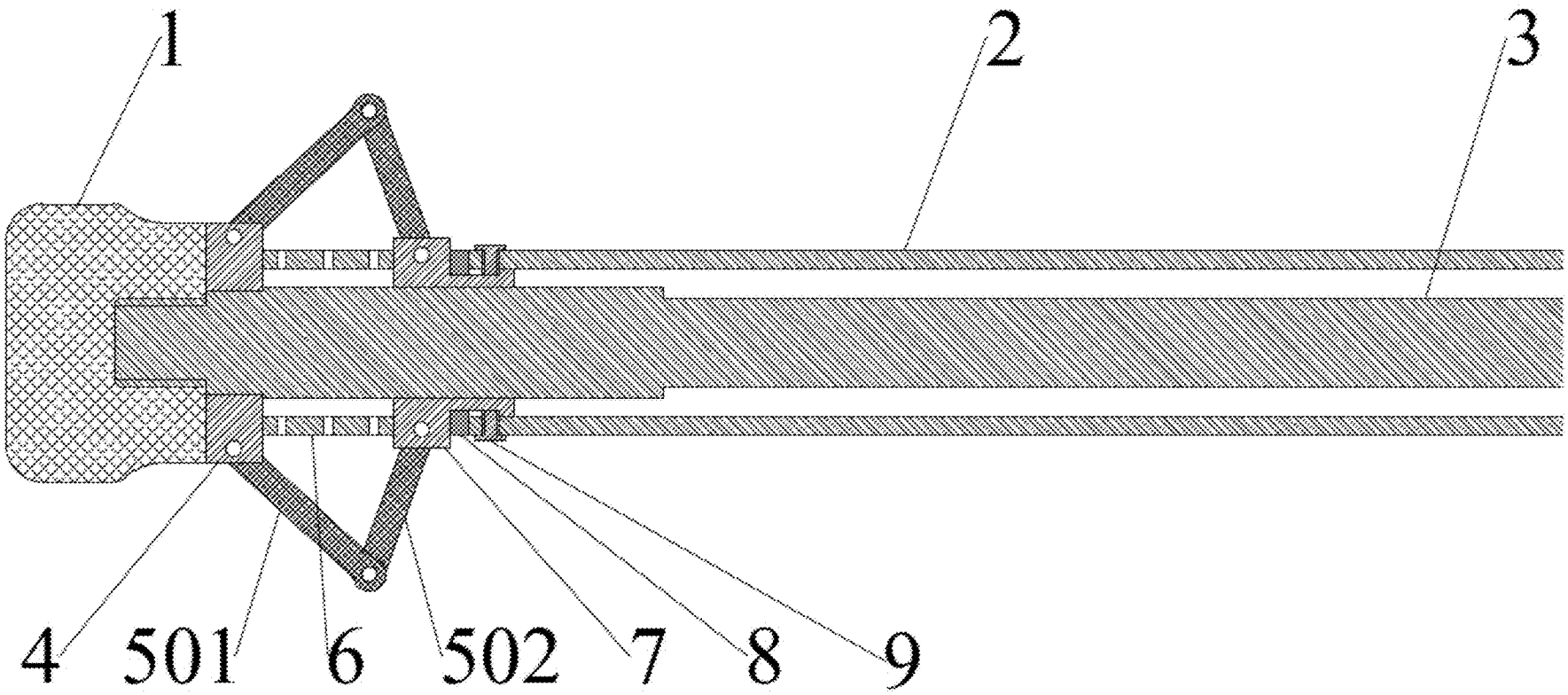
FIG. 12 is an expanded view of region B of FIG. 2.
Figure 13:
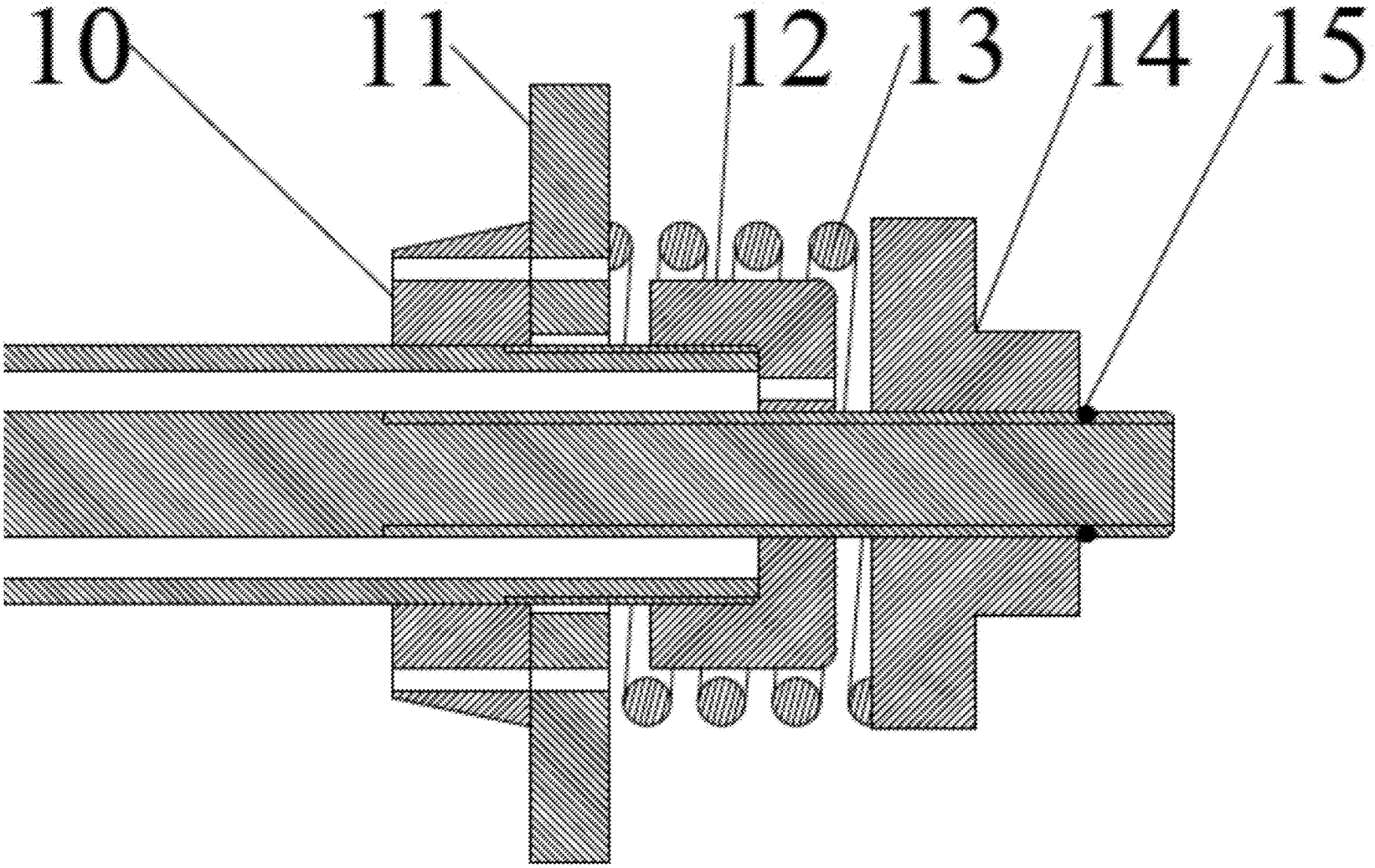
FIG. 13 is an expanded view of region C of FIG. 3.
Figure 14:
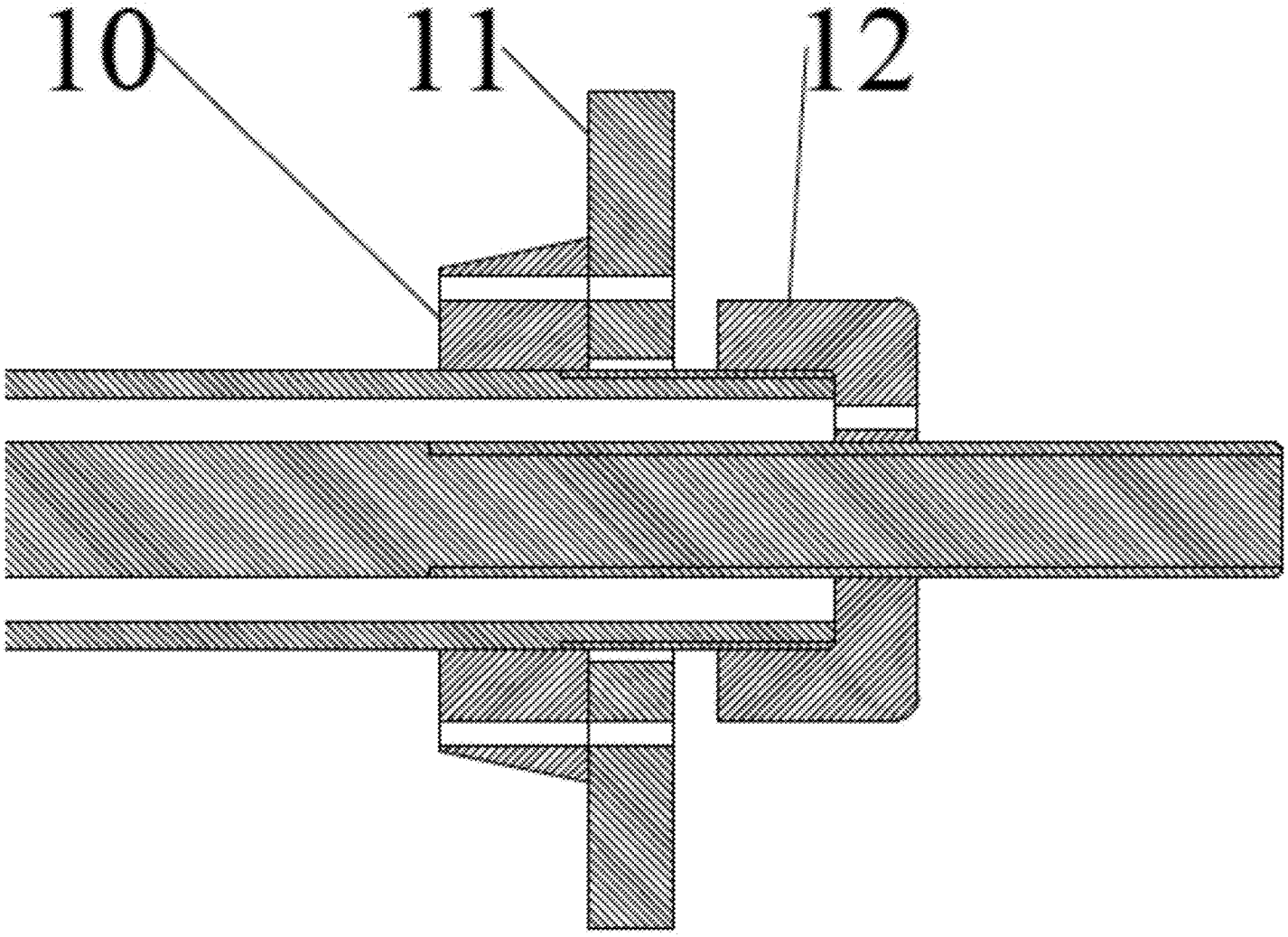
FIG. 14 is an expanded view of region D of FIG. 2.

As illustrated in FIG. 10, in step 4, rock bolt fastening is performed. After grout is initially solidified, the spring and the locknut are mounted at the outer anchor end, and a certain pre-tightening force is applied to the surrounding rock by using the locknut to compress the spring to produce a certain amount of compression.

The present invention is a reasonable combination of a drill bit, an anchor head assembly, a grouting pipe, a main shaft and an anchor tail assembly. It integrates the functions of drilling, differential grouting and rock bolting. The basic principle is as follows: the main shaft is located in the grouting pipe and concentric and coaxial with the grouting pipe; the inner anchor end of the rock bolt is provided with the drill bit and the expandable anchor head assembly; the outer anchor end of the rock bolt is provided with the grout stop plug and the anchor tail assembly; the inner anchoring point of the rock bolt is firm and reliable by virtue of the large-diameter anchor head assembly and fracture grouting; the connecting nut of the anchor tail assembly ensures the grouting pipe and the main shaft deforms in a coordinated manner; the spring not only enables the rock bolt to act in time and be in an active supporting state for a long time, but also has a certain cushioning and yielding effect. The grouting pipe anchors the surrounding rock in a small range acting as a full-length anchorage; the main shaft compresses and reinforces the surrounding rock in a large range; the grouting pipe anchorage zone and the main shaft anchorage zone interact with each other and cooperatively bear the load, such that the supporting performance can be effectively improved.

It should be pointed out that one skilled in the art may make various improvements and modifications without departing from the principle of the present invention, which, however, should be also considered as the protection scope of the present invention.

What is claimed is:

1. A self-drilling differential grouting composite rock bolt, consisting essentially of a drill bit (1), a grouting pipe (2), a main shaft (3), an anchor head assembly and an anchor tail assembly, wherein the drill bit (1) is connected to a front end of the main shaft (3); the grouting pipe (2) is sleeved over the main shaft (3), and an inner diameter of the grouting pipe (2) is greater than a diameter of the main shaft (3), so a grouting passage is formed between the grouting pipe (2) and the main shaft (3);

the anchor head assembly comprises a sliding ring (7), a limiting pipe (6), and a plurality of pairs of driven connecting rods (501) and driving connecting rods (502); the sliding ring (7) is sleeved over the main shaft (3) and connected to a front end of the grouting pipe (2); the limiting pipe (6) is sleeved over the main shaft (3) and located between the drill bit (1) and the sliding ring (7), and the limiting pipe (6) is provided with a plurality of grouting holes; a length of the limiting pipe (6) is smaller than a total length of one pair of driving connecting rod and driven connecting rod; the driven connecting rods (501) are uniformly distributed along a circumferential direction and hinged to the front end of the main shaft (3); the driving connecting rods (502) are uniformly distributed along the circumferential direction and hinged to the sliding ring (7); the driven connecting rods (501) and the driving connecting rods (502) are hinged with each other; and the anchor tail assembly comprises an anchor plate (11) and a connecting nut (12); the anchor plate (11) is sleeved over a rear end of the grouting pipe (2), and the connecting nut (12) is sleeved over the main shaft (3) and blocks the rear end of the grouting pipe (2); the connecting nut (12) is provided with a grouting hole connected with the grouting passage in the grouting pipe (2); the anchor plate is provided with a grouting hole and an exhaust hole.

2. The self-drilling differential grouting composite rock bolt according to claim 1, wherein the anchor head assembly further comprises a fixed ring (4), and the fixed ring (4) is fixed at a front part of the main shaft (3); each driven connecting rod (501) is hinged to the fixed ring (4), and a front end of the limiting pipe (6) is fixed to the fixed ring (4).

3. The self-drilling differential grouting composite rock bolt according to claim 1, wherein, when the driven connecting rods (501) are at a position parallel to the main shaft (3), an inner side of each driven connecting rod (501) is in contact with an outer surface of the limiting pipe (6), and a radius of a circle formed by hinging points on the sliding ring is smaller than a radius of a circle formed by hinging points on the fixed ring.

4. The self-drilling differential grouting composite rock bolt according to claim 1, wherein a foldable connecting rod unit is provided between adjacent driving connecting rods, and a grout stop screen (18) is provided between each foldable connecting rod unit and the sliding ring.

5. The self-drilling differential grouting composite rock bolt according to claim 4, wherein the foldable connecting rod unit consists of two brace rods (16) and a ratchet box (17), the two brace rods (16) are connected at one end by the ratchet box (17), and hinged at the other end to two adjacent driving connecting rods (502).

6. The self-drilling differential grouting composite rock bolt according to claim 1, wherein an inner wall of the sliding ring (7) is provided with grooves in axial direction, through which grout can enter the limiting pipe (6) from the grouting pipe (2).

7. The self-drilling differential grouting composite rock bolt according to claim 1, wherein a spring (13) is sleeved over the connecting nut (12); next to the connecting nut (12) is a locknut (14), having an outer end i& provided with a locking ring (15) capable of preventing the nut from being loosened.

8. The self-drilling differential grouting composite rock bolt according to claim 1, wherein a grout stop plug (10) is sleeved over an outer part of the grouting pipe (2); one grouting hole and one exhaust hole are drilled at two positions of both the grout stop plug (10) and the anchor plate (11).

9. The self-drilling differential grouting composite rock bolt according to claim 1, wherein each of the grouting pipe (2) and the main shaft (3) is integral or is formed by a plurality of sections connected by using connecting sleeves.

10. A method for anchoring the self-drilling differential grouting composite rock bolt of claim 1, comprising the following steps:

removing a spring and nut of a self-drilling differential grouting composite rock bolt, adjusting a connecting nut to make driven connecting rods to be parallel to a main shaft, using a bolter to rotate the composite rock bolt to drill a bolting hole with preset depth;

adjusting the connecting nut to enable a grouting pipe to push a sliding ring to a bottom of the hole such that driving connecting rods are pushed to protrude in a radial direction, at the same time, using the bolter to rotate the rock bolt to enable a hole diameter of the inner anchor end to be gradually expanded, and completing the hole expanding process of the inner anchor end as the sliding ring is stopped by a limiting pipe;

connecting a grouting pipeline with the grouting hole of the connecting nut, performing fracture grouting to rocks around the inner anchor end through an internal part of the grouting pipe by adopting high grouting pressure, then connecting the grouting pipeline with the grouting hole of the anchor plate, and performing permeation grouting to rocks around the grouting pipe through a gap between the grouting pipe and the bolting hole; and mounting the spring and a locknut at an outer anchor end after grout is initially solidified, and applying a pre-tightening force to the surrounding rock by using the locknut to compress the spring to produce a compression.

11. The self-drilling differential grouting composite rock bolt according to claim 2, wherein, when the driven connecting rods (501) are at a position parallel to the main shaft (3), the inner side of each driven connecting rod (501) is in contact with the outer surface of the limiting pipe (6), and the radius of the circle formed by hinging points on the sliding ring is smaller than the radius of the circle formed by hinging points on the fixed ring.

* * * * *